US009879949B2

(12) United States Patent
Roemer

(10) Patent No.: US 9,879,949 B2
(45) Date of Patent: Jan. 30, 2018

(54) MOVABLE TARGET SYSTEM AND METHOD

(71) Applicant: Benjamin C Roemer, Manitowish Waters, WI (US)

(72) Inventor: Benjamin C Roemer, Manitowish Waters, WI (US)

( * ) Notice: Subject to any disclaimer, the term of this patent is extended or adjusted under 35 U.S.C. 154(b) by 0 days.

(21) Appl. No.: 15/612,471

(22) Filed: Jun. 2, 2017

(65) Prior Publication Data

US 2017/0284776 A1 Oct. 5, 2017

Related U.S. Application Data

(62) Division of application No. 15/073,882, filed on Mar. 18, 2016.

(60) Provisional application No. 62/136,066, filed on Mar. 20, 2015.

(51) Int. Cl.

| | |
|---|---|
| ***F41J 9/02*** | (2006.01) |
| ***F41J 1/10*** | (2006.01) |
| *F41J 9/00* | (2006.01) |

(52) U.S. Cl.
CPC . *F41J 9/02* (2013.01); *F41J 1/10* (2013.01); *F41J 9/00* (2013.01)

(58) Field of Classification Search
CPC ..... F41J 9/00; F41J 9/02
USPC ..... 273/406, 359, 369, 370
See application file for complete search history.

(56) References Cited

U.S. PATENT DOCUMENTS

| | | | | | |
|---|---|---|---|---|---|
| 650,008 | A * | 5/1900 | Hamel | F41J 9/02 | 273/359 |
| 667,592 | A | 2/1901 | Smith | | |
| 766,112 | A | 7/1904 | Murray | | |
| 837,480 | A * | 12/1906 | Lee | B66C 1/62 | 104/113 |
| 1,075,518 | A * | 10/1913 | Thresher | F41J 9/02 | 273/359 |
| 1,318,467 | A | 10/1919 | Travell | | |
| 1,727,272 | A * | 9/1929 | Caswell | F41J 7/02 | 273/406 |
| 2,290,297 | A * | 7/1942 | Smith | F41J 9/02 | 212/98 |
| 2,344,829 | A * | 3/1944 | McAvoy | F41J 7/02 | 104/173.1 |
| 2,456,034 | A | 12/1948 | Suydam | | |
| 2,494,210 | A * | 1/1950 | Robinson | F41J 9/02 | 273/369 |
| 2,838,309 | A * | 6/1958 | Merz | F41J 7/02 | 273/406 |
| 3,020,047 | A * | 2/1962 | Spieth | F41J 7/02 | 273/406 |
| 3,140,874 | A * | 7/1964 | Jensen | F41J 9/02 | 273/369 |
| 3,363,900 | A * | 1/1968 | Cadle | F41J 9/02 | 273/359 |

(Continued)

FOREIGN PATENT DOCUMENTS

| | | |
|---|---|---|
| CN | 2470782 | 1/2002 |
| CN | 2597283 | 1/2004 |
| CN | 2658703 | 11/2004 |

*Primary Examiner* — Mark Graham
(74) *Attorney, Agent, or Firm* — Ryan Kromholz & Manion, S.C.

(57) ABSTRACT

A portable, moving target system that generates variable movements and mimics movements of prey. Movement of the target system may be varied in speed and pattern.

6 Claims, 10 Drawing Sheets

(56) References Cited

U.S. PATENT DOCUMENTS 3,388,910 A * 6/1968 Horta ..... A63F 9/02 273/368
3,471,153 A * 10/1969 Baumler ..... F41J 9/02 273/359
3,477,722 A 11/1969 Horta
3,637,210 A 1/1972 Brantley
3,770,914 A 11/1973 Larsen
3,865,373 A 2/1975 Knight
4,072,313 A 2/1978 Murso et al.
4,081,056 A 3/1978 Siitonen
RE30,013 E 5/1979 Knight
4,165,073 A 8/1979 Kellerstrass
4,286,788 A * 9/1981 Simington ..... A63B 69/0068 119/839
4,495,893 A 1/1985 Genelin
4,553,757 A 11/1985 Keeney
4,601,261 A * 7/1986 Genelin ..... A01K 15/027 119/839
4,738,223 A * 4/1988 Andreasen ..... A01K 15/027 119/839
5,242,172 A 9/1993 Bateman
5,367,232 A 11/1994 Netherton
5,431,409 A 7/1995 Webster
5,507,496 A 4/1996 Yeung
5,568,927 A 10/1996 Badorrek
5,688,196 A 11/1997 O'Neil
6,430,863 B1 * 8/2002 Krag ..... A01M 31/06 43/3
6,629,695 B2 10/2003 Tisdell
6,821,216 B1 * 11/2004 Van Asselt ..... A63B 69/0024 473/422
7,614,626 B1 11/2009 Aanerud
7,946,588 B1 5/2011 Hockman
8,074,994 B1 * 12/2011 Delphia ..... F41J 3/00 211/119.02
8,790,198 B1 * 7/2014 Russell ..... A63B 69/345 473/422
2007/0031206 A1 2/2007 Kreager
2008/0088089 A1 * 4/2008 Bliehall ..... F41J 9/02 273/359

* cited by examiner

MOVABLE TARGET SYSTEM AND METHOD

RELATED APPLICATIONS

This application is a divisional of co-pending application Ser. No. 15/073,882 filed 18 Mar. 2016, which claims the benefit of Provisional Patent Application Ser. No. 62/136,066 filed 20 Mar. 2015.

BACKGROUND OF THE INVENTION

The present invention relates generally to targets and more specifically to a manually operable moving target system for improving the accuracy of a shooter. Targets have been used for many years for practice and to aid users in improving shooting skills and accuracy. Targets may come in various sizes and configurations to match the intent and needs of the user. Furthermore, targets may be moveable to mimic the moving prey a hunter may encounter or to increase difficulty for the user, thereby further enhancing a target practice session. Known target devices may be difficult to transport or assemble. Further, many targets do not adequately challenge a user to improve his accuracy, either due to its stationary nature, or because the movement of a moving target is predictable, unrealistic, or otherwise simplistic in manner.

SUMMARY OF THE INVENTION

The present invention provides a moving target system that is portable, easy to transport and install, and may be used as both a moving and stationary target. The present device may be used indoors or outside, as desired. Moreover, the present system is able to generate movements that challenge the user and mimic movements of prey in a more realistic manner than known systems. Further, movement of the present target system may be varied in speed and pattern to create a more challenging arrangement for the user, all while keeping the operator out of the line of fire.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
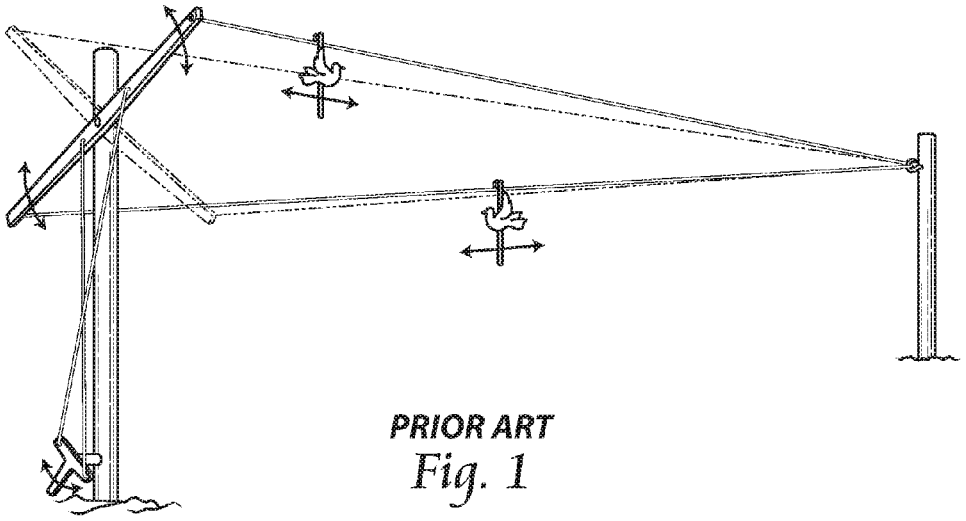
PRIOR ART Fig. 1
FIG. 1 is a perspective view of a prior art movable target.
Figure 2:
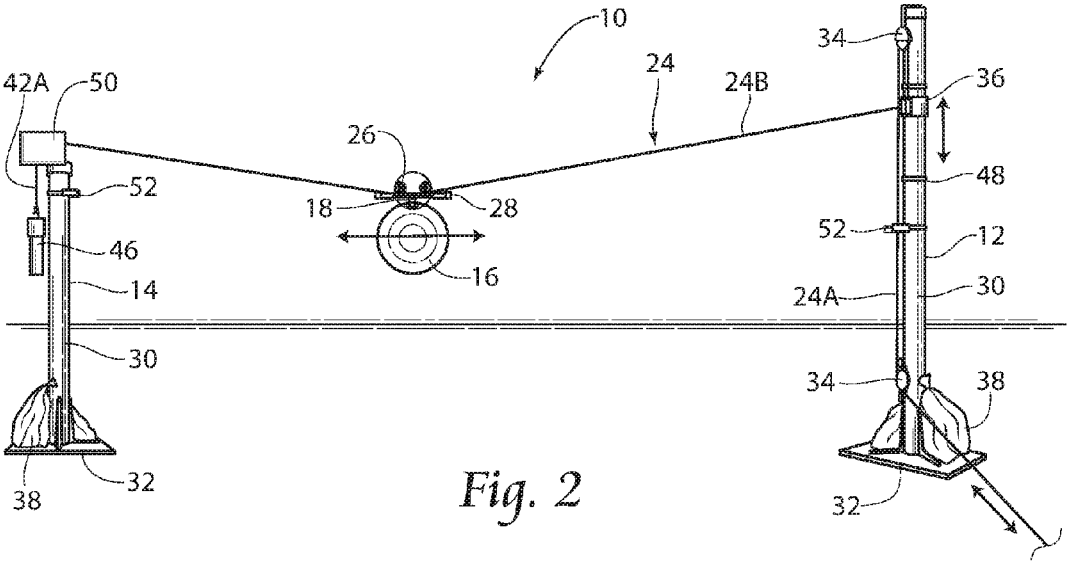
FIG. 2 is a view of a movable target system according to the present invention and showing operation of the device.

With attention to FIG. 2, a target system 10 according to the present invention may be seen. As shown, the system 10 preferably includes a first support post 12, a second support post 14, a target member 16, and a target support element 18. As viewed in FIG. 3A, the target support element 18 includes an attachment structure 20, such as the side buckle shown, for releasable attachment to a corresponding mating attachment structure 20A on the target member 16. Although a side buckle is shown, it is to be understood that other releasable or non-releasable attachment structures may be used without departing from the invention. The target support element 18 further preferably includes at least one rolling support member 22, seen as a pair of grooved wheels 22A in these views. A rolling support member 22 for use with the present invention is preferably adapted to engage and be supported on an elongated member 24. As shown, the elongate member 24 includes two elongate member portions 24A, 24B and is preferably fabricated from wire, cable, cord or other suitably strong and flexible material which is supportable between the first and second support posts 12, 14, as will be discussed.

Figure 3A:
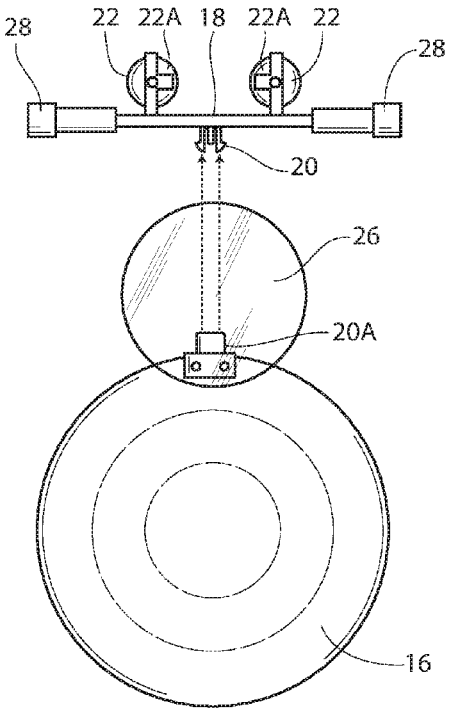
FIG. 3A is a view of a target for use with the present system and showing a detachable target support.
Figure 3B:
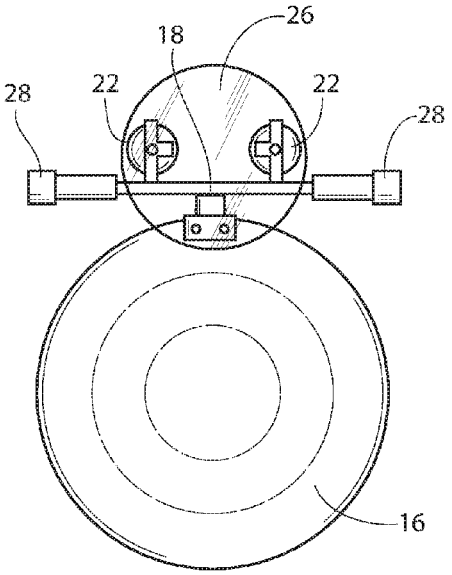
FIG. 3B is a view similar to that of FIG. 3, but showing the target attached to a target support.

With particular attention to the views of FIGS. 3A and 3B, a target support element 18 for use with the present invention may further include a shield member 26 to protect the rolling support member 22 from damage. The target support element 18 may also include laterally opposed bumper members 28 to reduce concussive force with the support posts 12, 14 during use. The target member 16 may be of any traditional configuration, such as the circular target shown, or any other configuration that is supportable on the target support element 18 and desirable by a user (not shown) of the system 10.

With reference now to FIGS. 4A-4D, a first support post 12 may be seen. As shown, the support post 12 includes an upright member 30, a base member 32, a pulley system having a plurality of pulley members 34, and a slidable collar member 36. The base member 32 may be secured by way of weights 38, or other suitable means to temporarily anchor the support post 12 during use. While weights 38 are shown, it is to be understood that other devices such as stakes, screws or the like, capable of anchoring the base member 32 during use, may be used without departing from the spirit of the invention. A pulley system having a plurality of pulley members 34 is arranged to receive an elongate member 24, such as the wire shown. As may be seen, particularly in FIGS. 4A and 4B, a first elongate member portion 24A is arranged around the pulley members 34 and is attached to the collar member 36 at attachment structure 44 by way of the eye hook 56 shown, or other suitable means. Sliding movement of the collar member 36 along the upright member 30 occurs when an end 42 (see FIG. 6A) of the elongate member first portion 24A is pulled in the direction of arrow A. As the end 42 is pulled in the direction of arrow A, elongate member first portion 24A rides along the pulleys 34 and lifts the attached collar member 36 in the direction of arrow D.

Figure 4A:
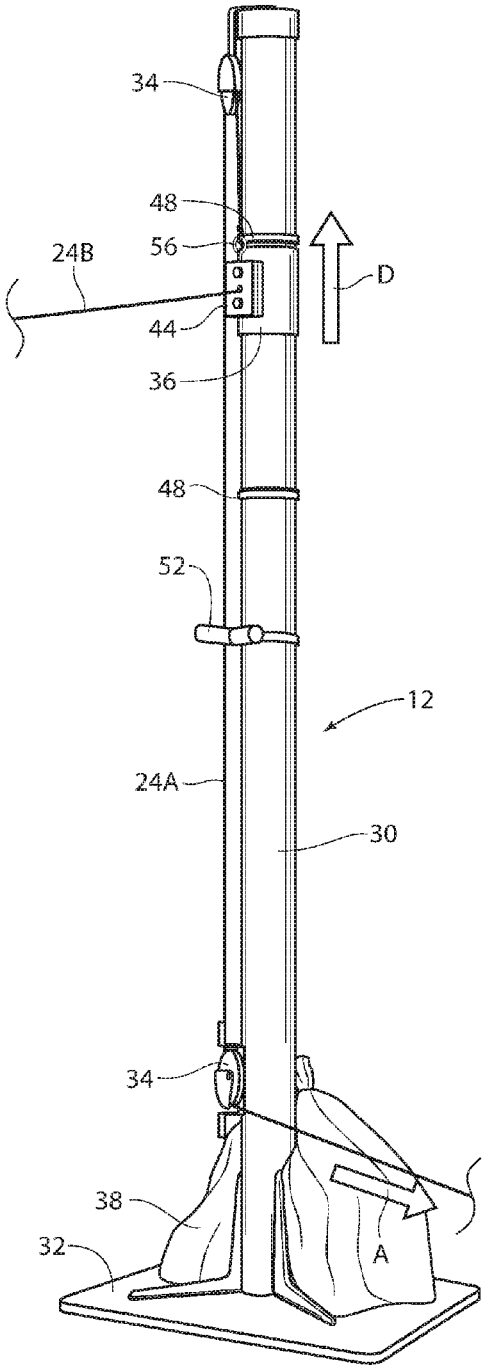
FIG. 4A is a view of a first upright support post for use with the present system and showing movement of the slidable collar and pulley with tension applied to the elongate support member.
Figure 4B:
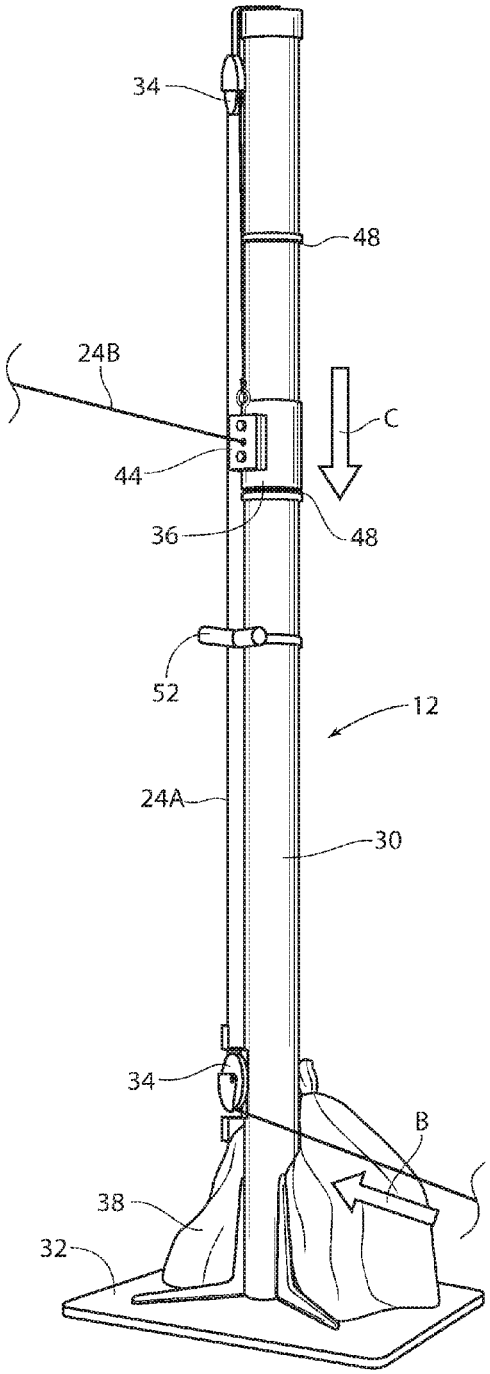
FIG. 4B is a view similar to that of FIG. 4A, but showing movement of the slidable collar with tension released from the elongate support member.
Figure 4C:
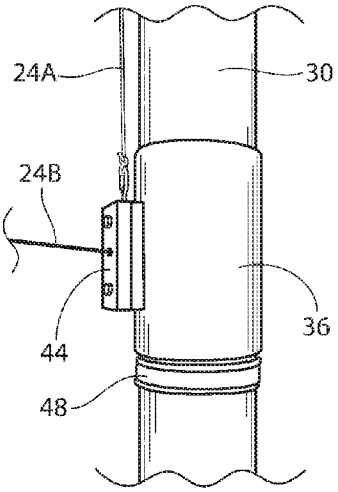
FIG. 4C is an enlarged view of the first support post and showing the collar with attached elongate support member.
Figure 4D:
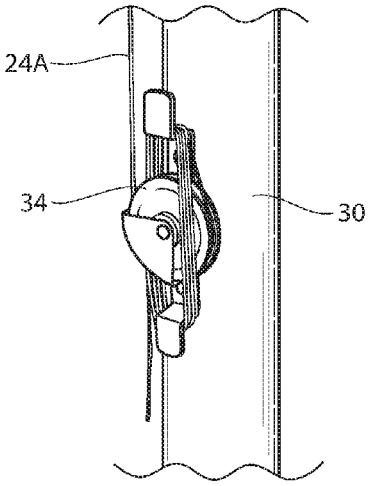
FIG. 4D is an enlarged view of a lower portion of the first support post and showing the elongate support member in stowed position.

With specific reference now to FIG. 4B, a contrary action of elongate member portion 24A may be seen. As shown, the end 42 of elongate member portion 24A may be released and moved in the direction of arrow B. Movement in the direction of arrow B lowers the collar member 36 in the direction of arrow C. Longitudinal movement of the collar member 36 along the upright member 30 in the direction of arrows C, and D translates into movement of the second elongate member portion 24B. Movement of the collar member 36 in either arrow direction C, D is restricted by limit bands 48. Placement of the limit bands 48 on the upright member 30 defines maximum upper and lower travel of the collar member 36. The limit bands 48 may be adjusted along the upright member 30 to vary the longitudinal travel distance of the collar member 36 and thereby adjust movement of the target member 16. The effect of the relative movement of the elongate member portion 24B and the collar member 36 on the target member 16 will be discussed with reference to the views of FIGS. 6A-6D.

Figure 5A:
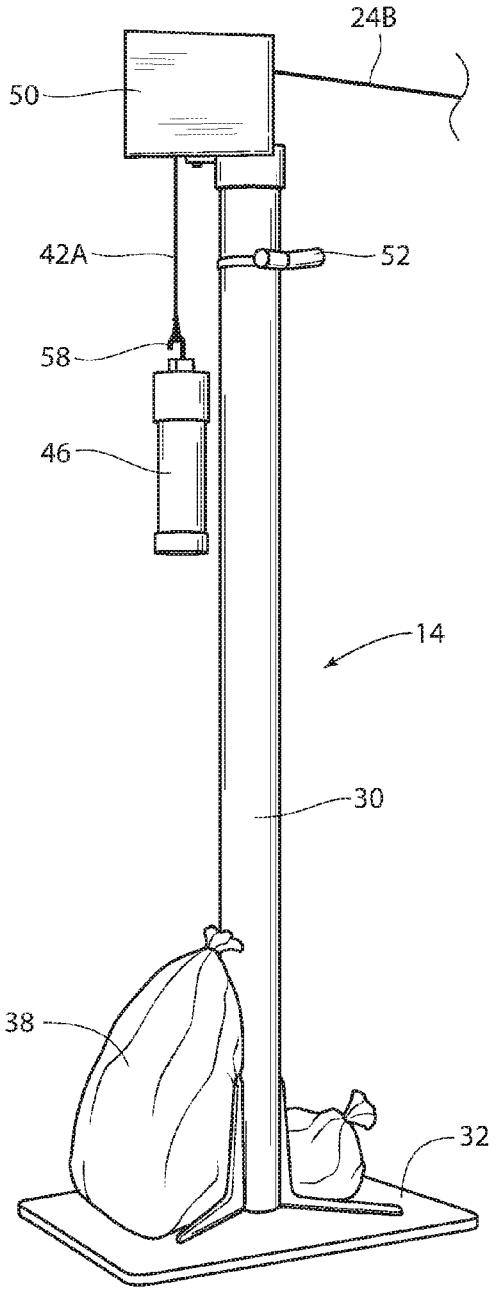
FIG. 5A is a perspective view of a second support post for use with the present system and showing a counterweight attached to the elongate support member.
Figure 5B:
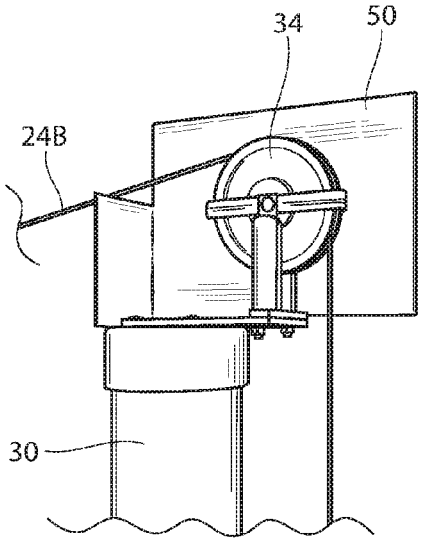
FIG. 5B is an enlarged fragmentary view of the support post illustrated in FIG. 5A and showing the reverse side of an upper portion with pulley system for use with the counterweight.
Figure 6A:
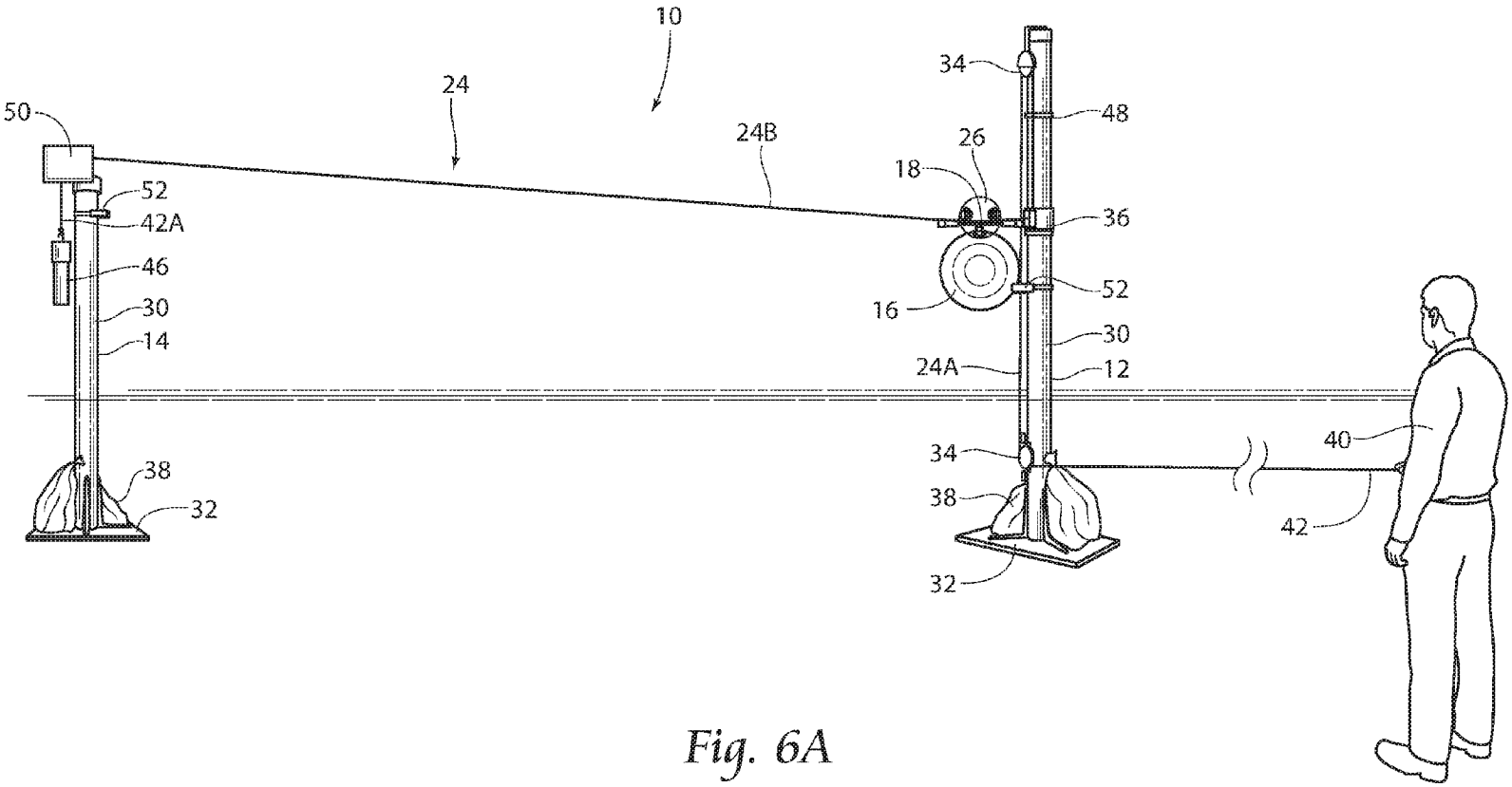
FIG. 6A is a perspective view of the movable target system illustrated in FIGS. 1-5B and showing a method of operating the device with the operator controlling tension on the elongate support member, the collar in a first position, and the target adjacent a support post.
Figure 6B:
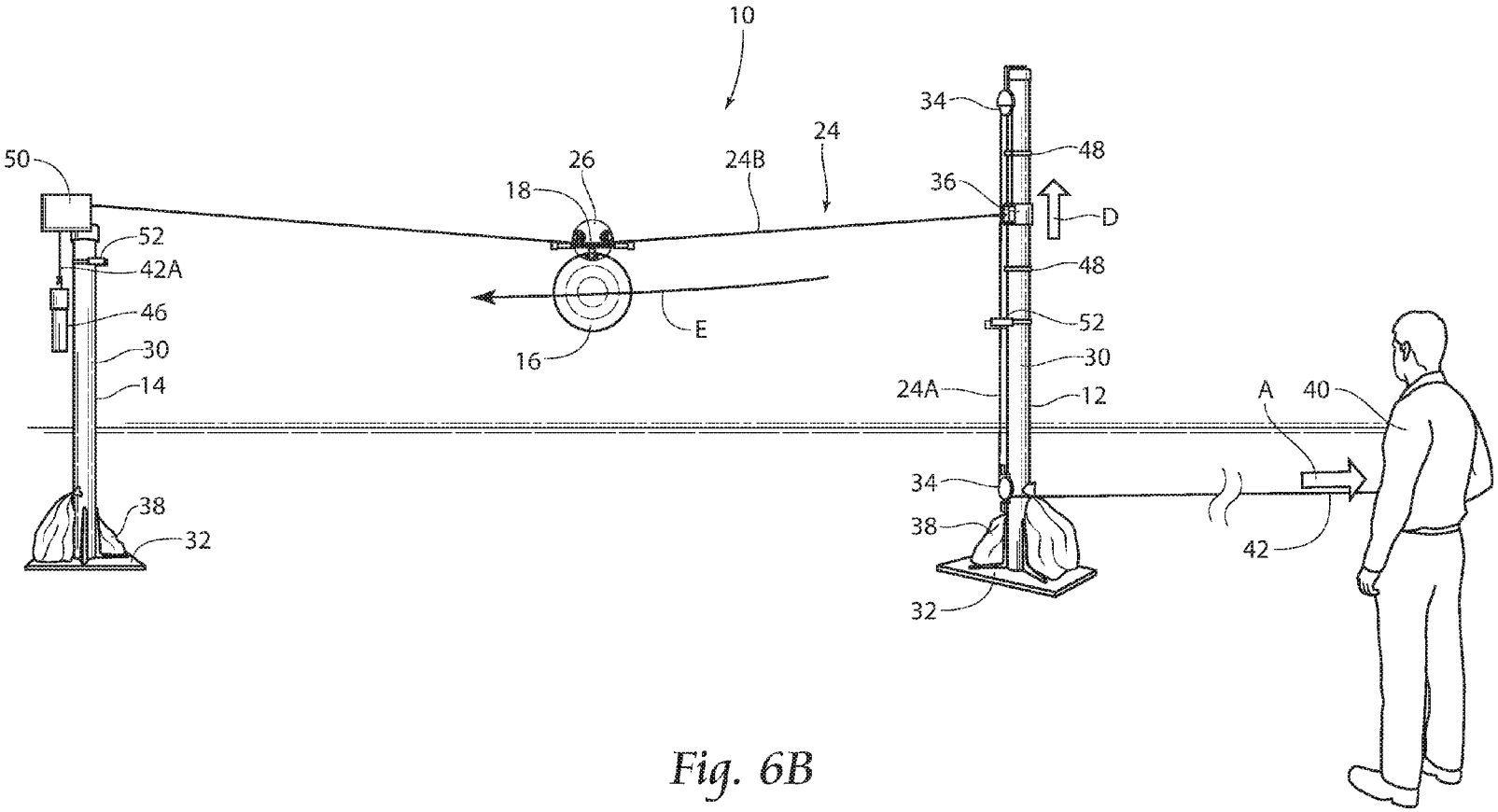
FIG. 6B is a perspective view of the movable target system similar to that of FIG. 6A, and showing a step of operating the device with the operator increasing tension on the elongate support member, the collar rising to a second position, and the target moving between the support posts.
Figure 6C:
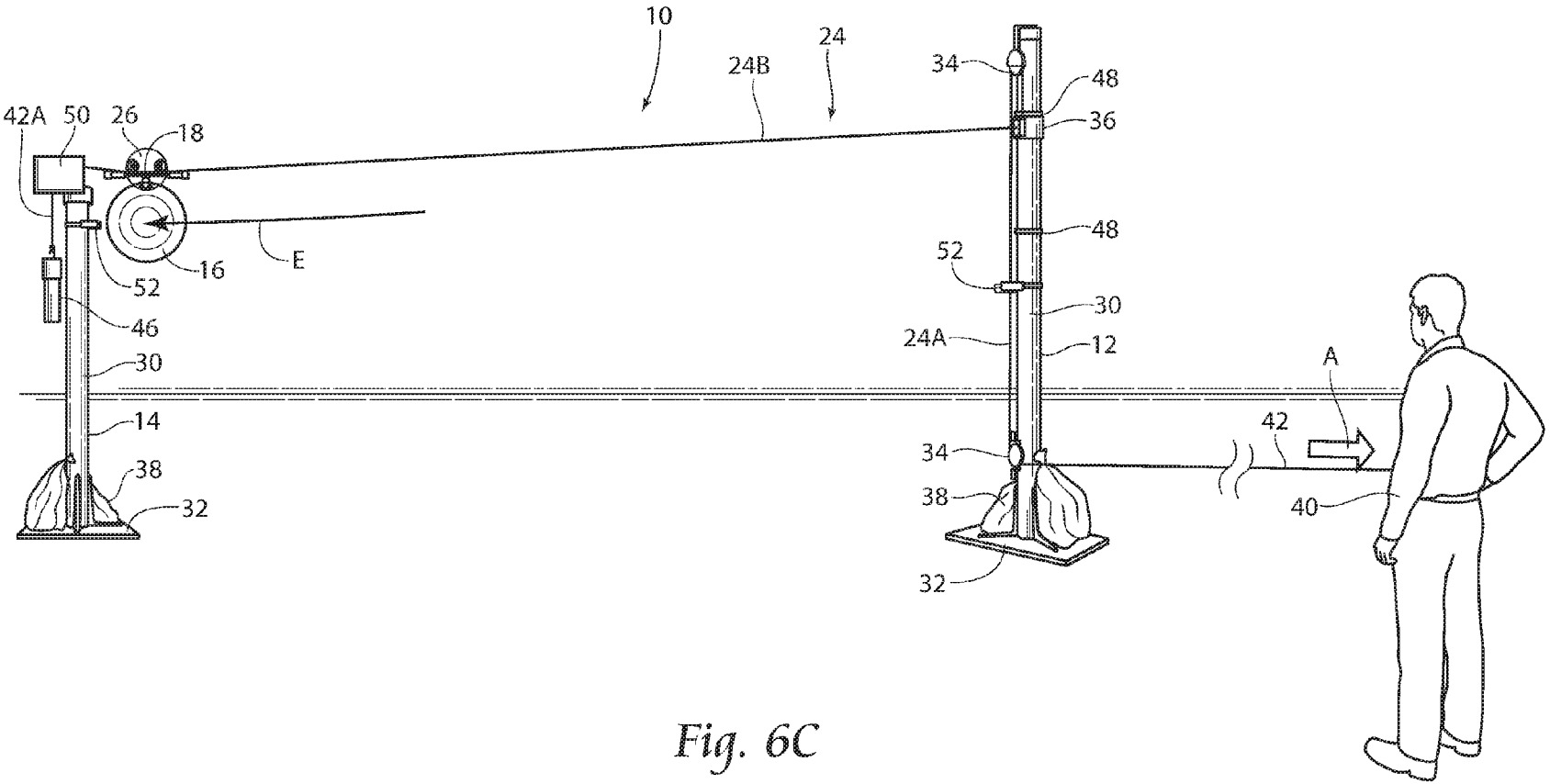
FIG. 6C is a perspective view of the movable target system similar to that of FIGS. 6A and 6B and showing a further step of operating the device, with the operator increasing tension on the elongate support member, the collar rising to a third position, and the target moving toward an opposite support post.

FIGS. 5A and 5B illustrate a second target support post 14. Similar to the first support post 12, the second support post 14 includes an upright member 30, a base member 32, and at least one pulley 34. AS with the first support post 12, the base member 32 of the second support post 14 may be secured by way of weights 38, or other suitable means to temporarily secure the base member 32 during use. As seen, an end 42A of elongate member portion 24B is supported by a pulley member 34 and is further attached to a counterweight 46 by known means, such as the hook 58 shown. The counterweight 46 provides proper balance and tension on the elongate member 24 during use. Moreover, the counterweight 46 keeps the elongate member portion 24B taut with an even tension while providing enough slack to permit the operator 40 to motivate the target member 16 while manipulating the collar member 36 during use. As is shown in FIG. 5B, the support post 14 may further include a protective element, such as the shield 50 shown, to protect the pulley 34 from impact during use. Moreover, each upright 30 may preferably include a target bumper 52 which may be variably positioned to align with the trajectory of target member 16. The views of FIGS. 6A and 6C illustrate use of the target bumper 52 to cushion the target member 16 as it reaches each post 12, 14 during use.

FIGS. 6A-6D particularly illustrate longitudinal movement of the collar member 36 on the upright 30, along with the concomitant movement of the elongate member 24 and target member 16. As is shown, an operator 40 engages an end 42 of elongate member portion. 24A and moves it in the direction of arrow A. The collar member 36 rider along the upright member 30 in the direction of arrow D. As the collar member 36 elevates in the direction of arrow D, the attached elongate member portion 24B also rises and the target support 18 and attached target member 16 move along rolling support 22 in the direction of arrow E.

Figure 6D:
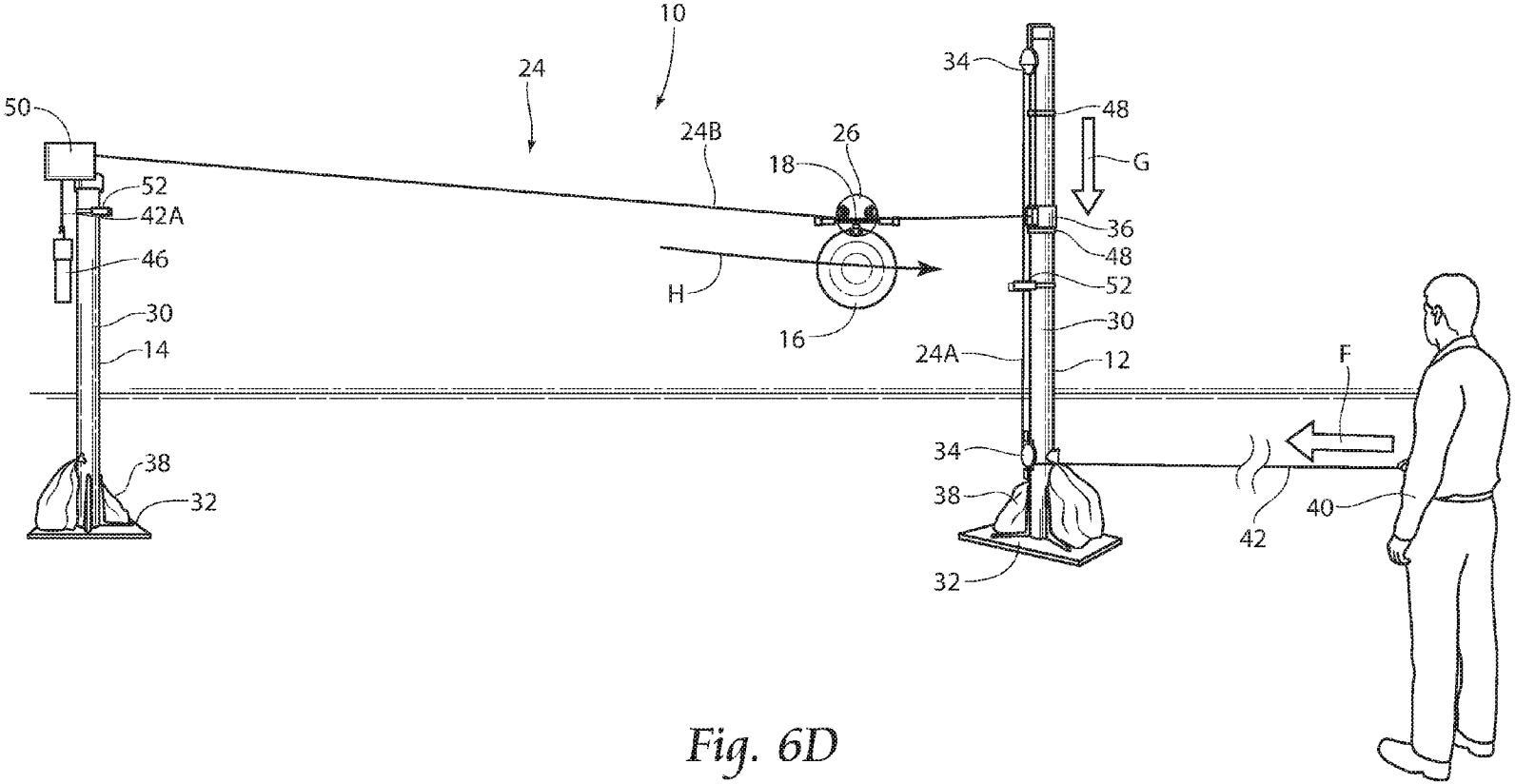
FIG. 6D is a perspective view of the movable target system similar to that of FIGS. 6A, 6B, and 6C and showing a another step of operating the device, with the operator decreasing tension on the elongate support member, the collar falling to a lower position, and the target moving back toward the first support post.

With attention to FIG. 6D, movement of the target member 16 in another direction is seen as the operator 40 releases tension on the elongate member portion 24A in the direction of arrow F. As is illustrated, the collar member 36 moves in the direction of arrow G, and the target support 18 and attached target member 16 move in the direction of arrow H. The operator 40 may vary the duration of tension in arrow directions A, F and also vary the distance the collar member 36 travels in arrow directions D, G to thereby add unexpected deviation in target member 16 position as may be desired by the practicing target user (not shown). In this manner, the tensioning and re-tensioning of the elongate member portion 24A by the operator 40 causes the collar member 36 and attached elongate member portion 24B to move as described, and be manipulated in a non-linear and unpredictable manner. The unpredictable and non-linear movement of the target member 16 challenges the user (not shown) to improve shooting accuracy.

Figure 7:
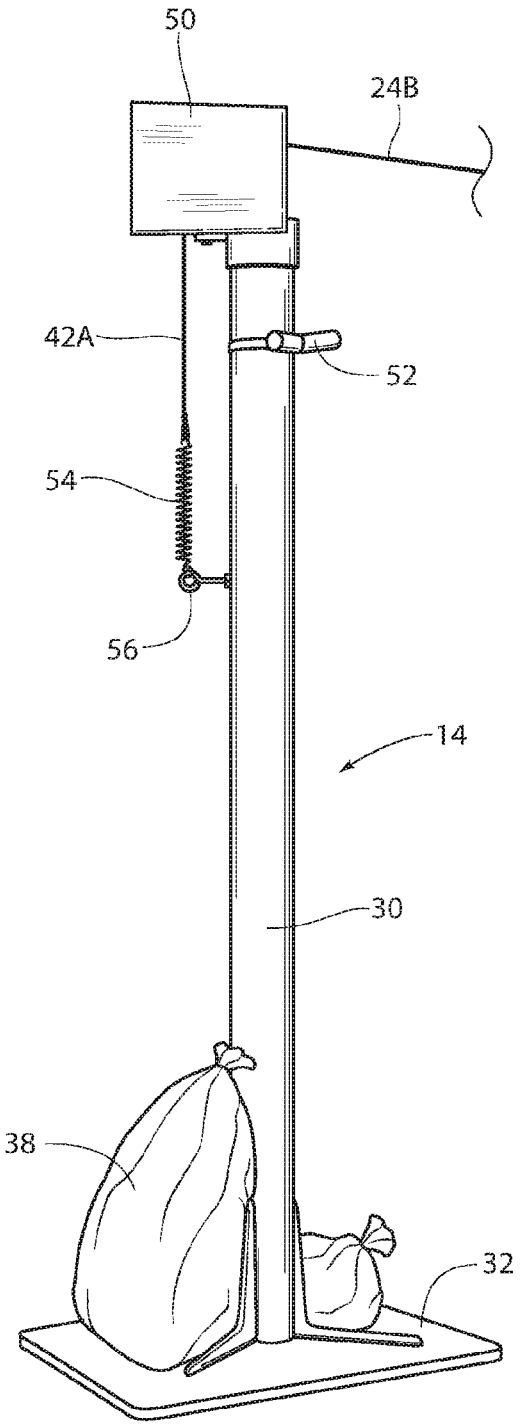
FIG. 7 is a view of a second support post for use with the present system, similar to that of FIG. 5A, but showing a spring member providing tension and attached to the elongate support member.
Figure 8:
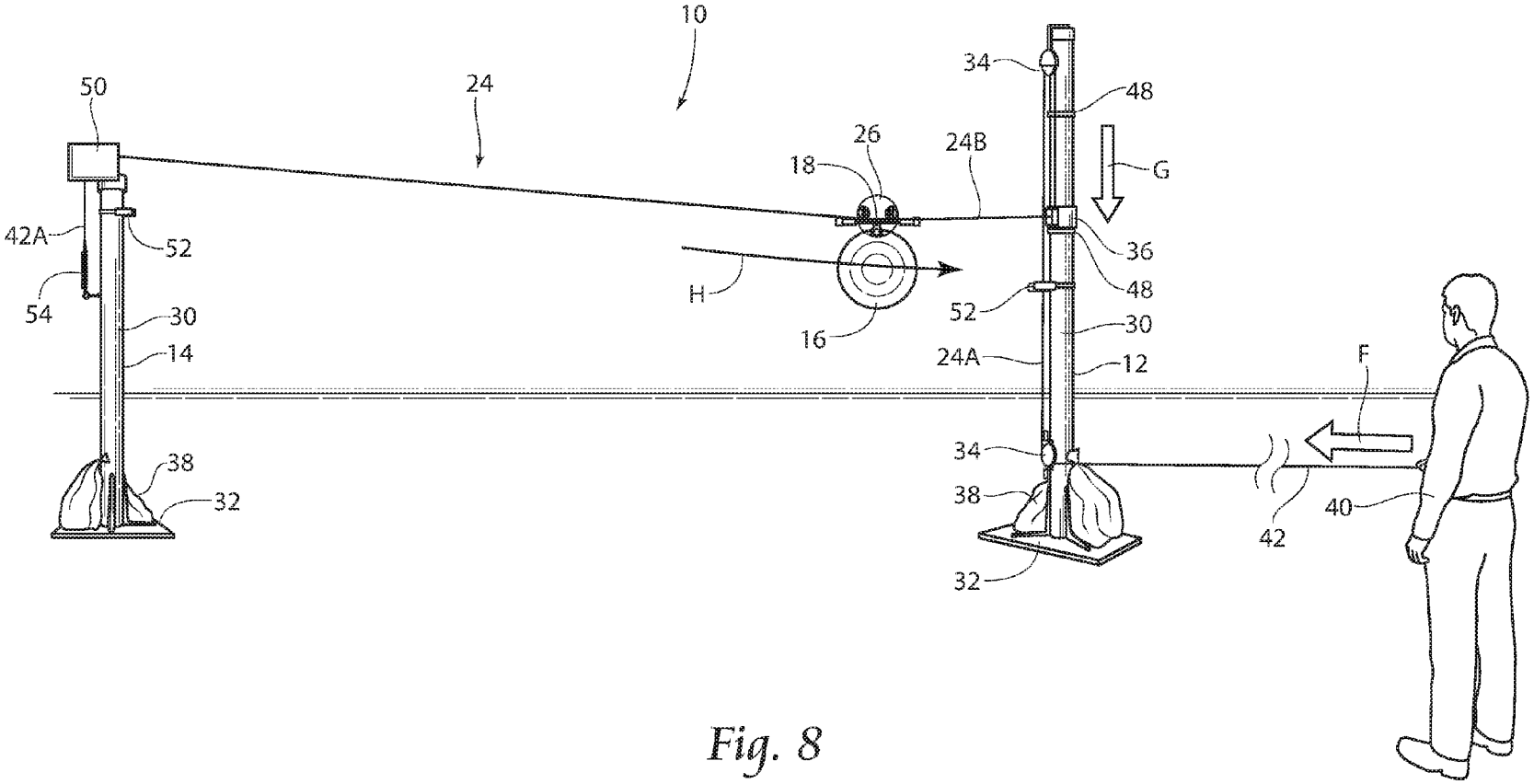
FIG. 8 is a perspective view similar to that of FIG. 6D, but illustrating a system utilizing the spring member shows in FIG. 7.

In an alternative embodiment and as seen in FIGS. 7 and 8, a spring member 54 may be utilized in place of the previously described counterweight 46. As illustrated, the spring member 54 functions in a manner similar to that of the counterweight 46, with the second end 42A of the elongate member portion 24B being attached to the spring member 54. The spring member 54 may be further supported on the upright 30 by way of known means, such as the eye hook 56 shown. A preferred spring member 54 tension will provide sufficient force on the elongate member portion 24B to keep the elongate member portion 24B taut during use while providing enough slack to permit the operator 40 to motivate the target member 16 while manipulating the collar member 36. Moreover, the spring member 54 will maintain an even tension while the operator 40 manipulates the elongate member portion 24A, and collar member 36 during use.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A method of moving a target on a target system including the steps of:

providing a first support post and a second support post;

arranging a slidable collar member around said first support post;

providing a target member;

providing a target support element;

providing an elongate member, said elongate member including a first elongate member portion and a second elongate member portion and wherein said first elongate member portion includes a first end and a second end, said first end arranged for manual manipulation, and said second end being attached to said collar member;

providing said collar member with an attachment structure;

attaching a first end of said second elongate member portion to said attachment structure;

attaching a second end of said second elongate member portion to said second support post; and manipulating said first end of said first elongate member portion to thereby move said target member.

2. The method of claim 1 including the further step of providing said target support element with an attachment structure, said attachment structure arranged for releasable attachment to a corresponding mating attachment structure on said target member.

3. The method claim 2 including the further step of providing said target support element with at least one rolling support member, said at least one rolling support member arranged for sliding engagement with said elongate member.

4. The method of claim 3 including the further step of providing said at least one rolling support member with a pair of grooved wheels.

5. The method of claim 4 including the further step of providing a pulley system having a plurality of pulley members arranged to receive said elongate member.

6. The method claim 5 including the step of providing said target support element with a shield member and laterally opposed bumper members.

* * * * *